United States Patent [19]

Widmer et al.

[11] 4,096,481

[45] Jun. 20, 1978

[54] QUICK DISCONNECT C.B. ANTENNA WITH A KEY LOCKING MEANS

[75] Inventors: Stanley W. Widmer, Coon Rapids; Bernard C. Salchow, St. Paul, both of Minn.

[73] Assignee: Stanley Widmer Associates, Inc., Minneapolis, Minn.

[21] Appl. No.: 727,008

[22] Filed: Sep. 27, 1976

[51] Int. Cl.[2] ..... H01Q 1/32

[52] U.S. Cl. ..... 343/715; 343/720; 174/153 A; 70/167

[58] Field of Search ..... 343/711–715, 343/888, 720; 70/57, 58, 167; 285/85, 82, 205 R; 174/153 A, 138 A; 339/89 C, 93 C

[56] References Cited

U.S. PATENT DOCUMENTS

| | | | |
|---|---|---|---|
| 3,090,960 | 5/1963 | Ingledew | 343/713 |
| 3,170,748 | 2/1965 | Van Horssen | 285/85 |
| 3,544,140 | 12/1970 | Langheck | 343/715 |
| 3,545,148 | 12/1970 | Mandino | 343/715 |
| 3,812,279 | 5/1974 | Voegeli | 70/167 |

*Primary Examiner*—Alfred E. Smith
*Assistant Examiner*—David K. Moore
*Attorney, Agent, or Firm*—Kinney, Lange, Westman and Fairbairn

[57] ABSTRACT

A quick disconnect, lockable mounting for a C.B. (citizens band) antenna, or other type of antenna, which permits removing the antenna whenever desired simply by unlocking a key lock device, and taking off a cap carrying the antenna. Yet, when the cap is in position, it cannot be removed because the lock member securely holds it in position.

The problem associated with breaking and stealing C.B. antennas (and radios, which are indicated as being present in a vehicle by the full antennas) has increased substantially, and the present device permits not only the quick disconnect and removal of the antenna, but the locking of the antenna to discourage thieves from attempting such removal.

7 Claims, 7 Drawing Figures

FIG. 1
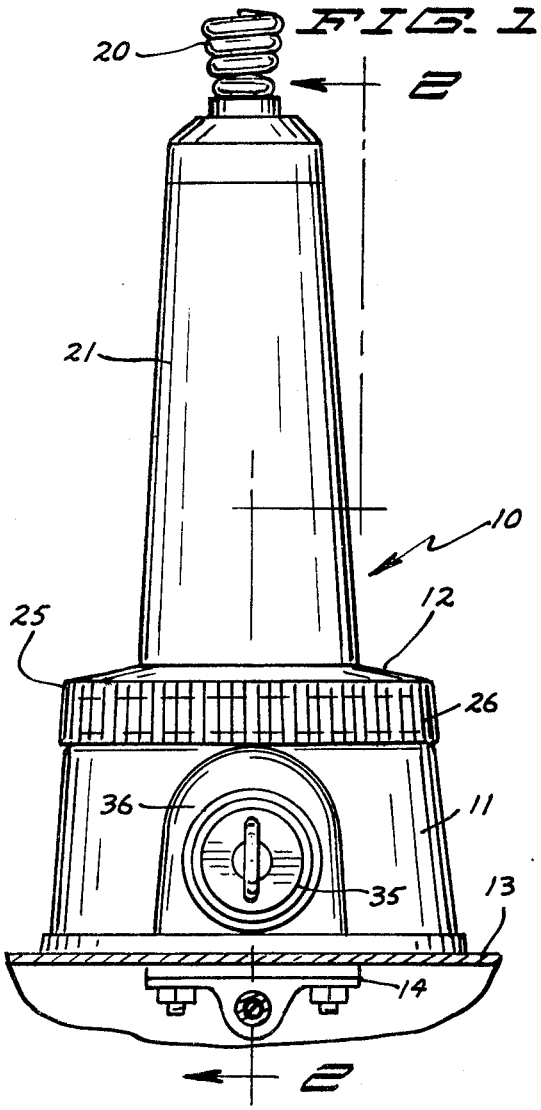
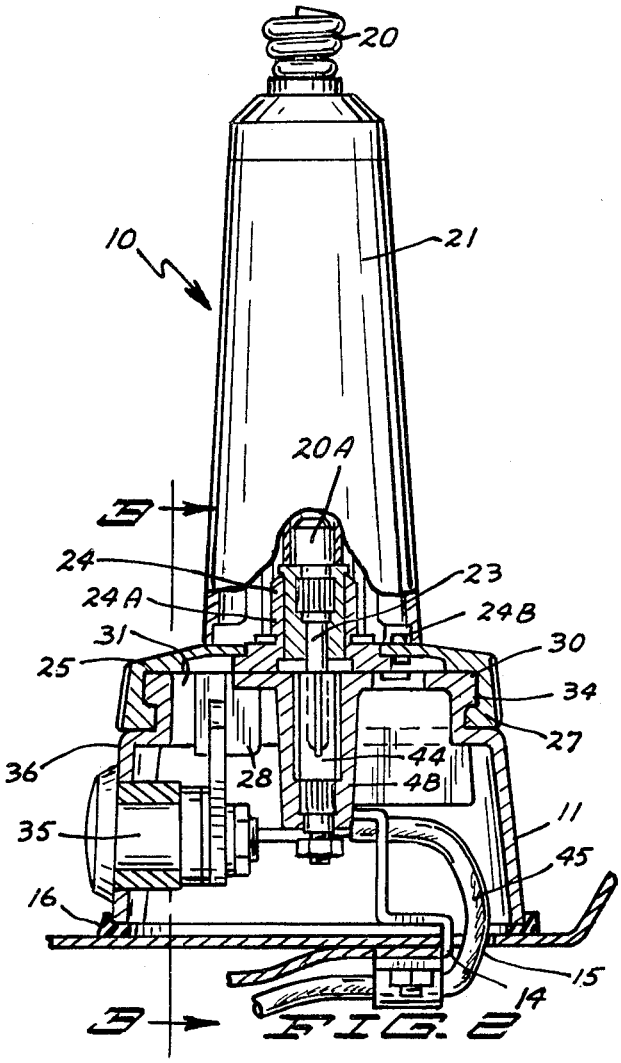
FIG. 2
FIG. 3
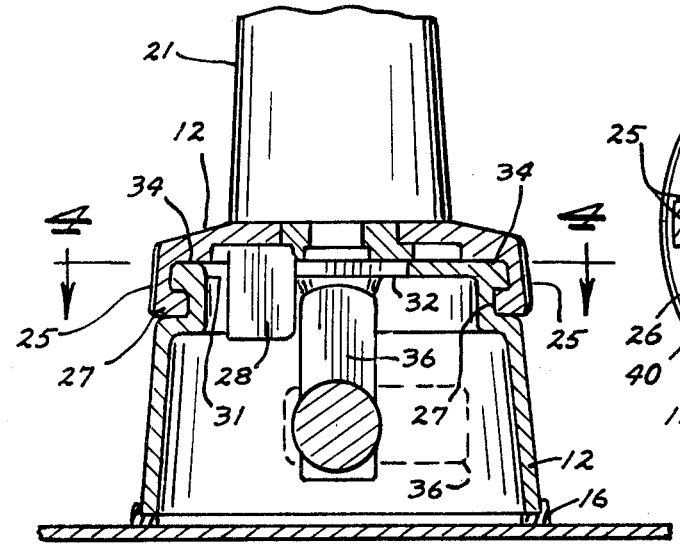
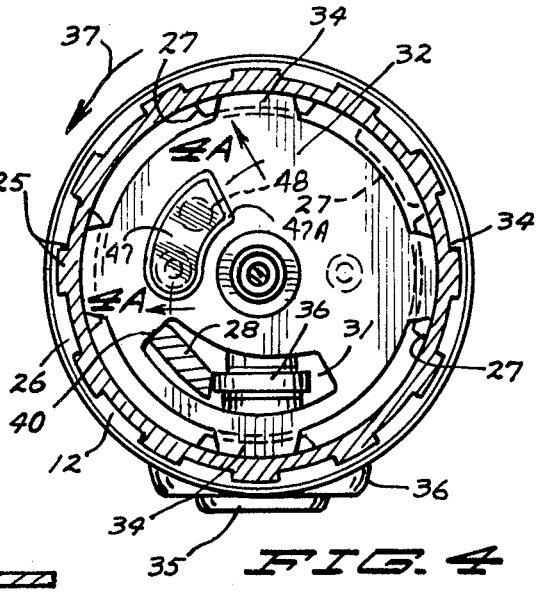
FIG. 4

FIG. 5
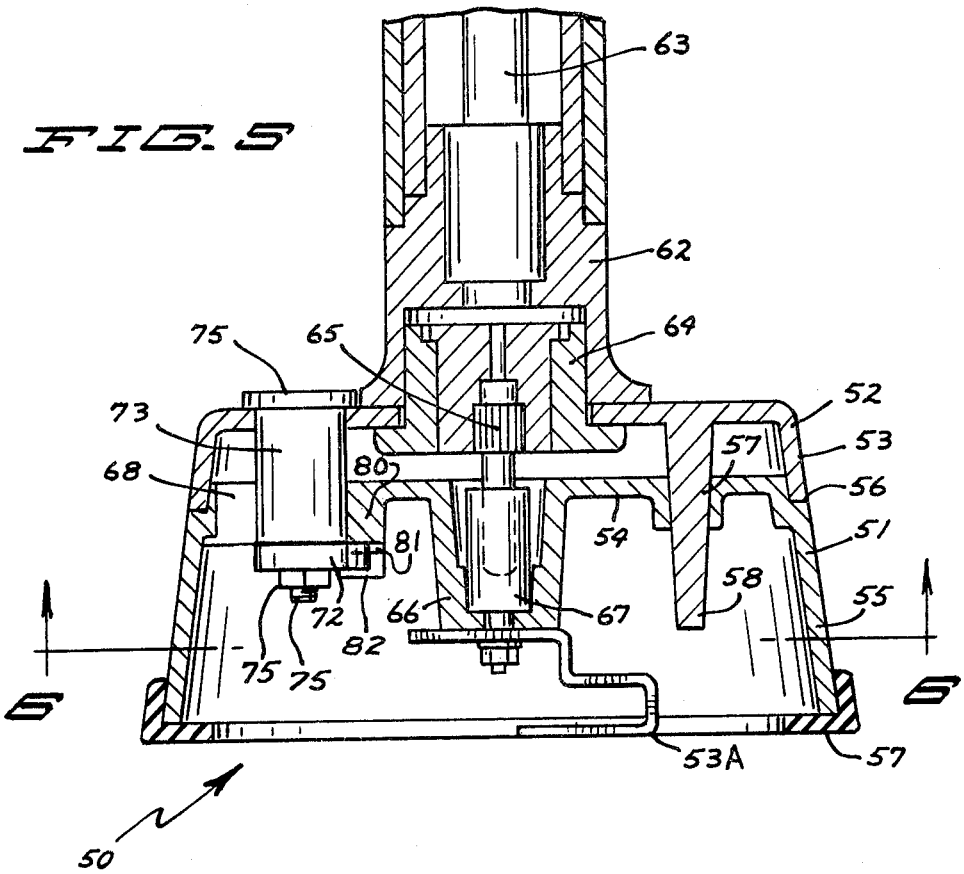
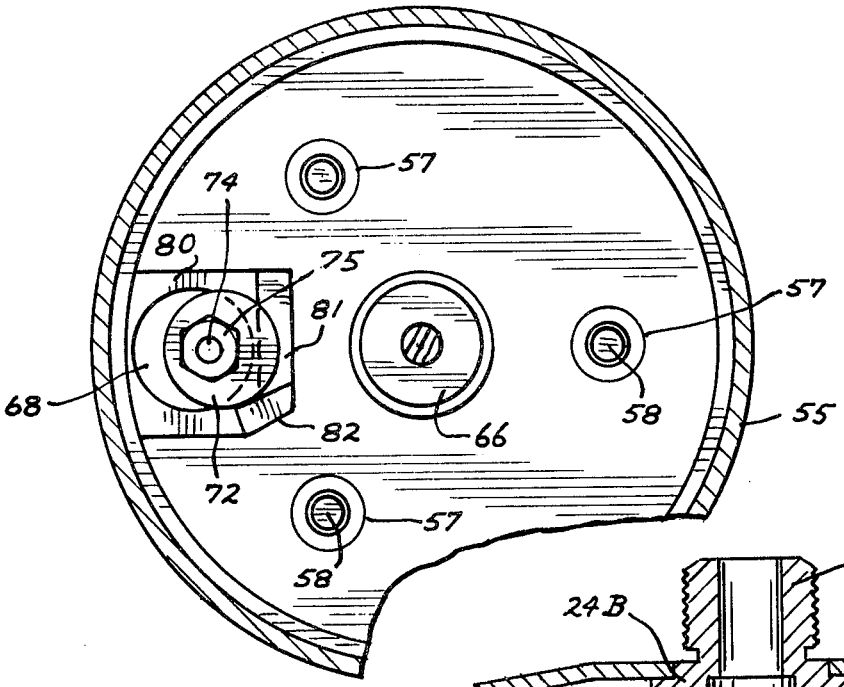
FIG. 6
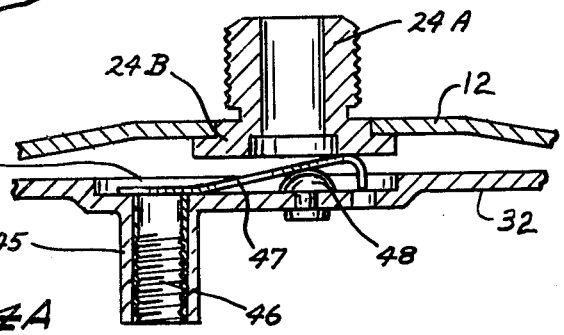
FIG. 4A

QUICK DISCONNECT C.B. ANTENNA WITH A KEY LOCKING MEANS

BACKGROUND OF THE INVENTION

1. Field of the Invention

The present invention relates to quick disconnect, lockable mounting couplers for antennas.

2. Prior Art

In the prior art various devices have been advanced which show relatively lockable disconnectable members. U.S. Pat. No. 3,812,279 shows a cable television housing with the cover and base, and a key lock member for securing the cover and base when they are mounted together. When the key lock member is locked, the parts are prevented against relative rotation, but in a much different environment and with different specific construction.

U.S. Pat. Nos. 3,545,148; 3,492,769; and 3,369,247 deal specifically with automotive antenna mounting brackets, but none of which show a quick disconnect with a locking device. U.S. Pat. No. 3,492,769 does show a threaded nut that can be used for a connector, and U.S. Pat. No. 3,545,148 shows contactor connections that appear to be threaded together rather than quick disconnect devices, with a key lock for preventing tampering.

A tool lock is shown in U.S. Pat. No. 1,417,411 with a locking pin operated by a rotating member, and U.S. Pat. No. 2,147,026 shows a coupling that has a locking pin operated by a lever.

Australian Pat. No. 23,114 shows a twist lock base for an electric lamp, but not one which includes a key lock feature, and U.S. Pat. No. 3,521,218 shows a type of a lock for a heavy duty connector.

SUMMARY OF THE INVENTION

The present invention relates to a construction for mounting antennas or the like onto a surface such as a panel of an automobile, and which will permit removal of a cap and antenna portion from a base portion of the coupler when the device is unlocked, but which prevents removal of the antenna when the cap is locked, without damaging or breaking the antenna or the mounting base itself.

The present device involves a connector which is made of two parts, a base which can be attached to a surface in the normal manner, and a cap which houses the base or lower portion of an antenna. The cap is attachable and removable relative to the base portion of the connector, and at the same time the cap is installed the antenna itself is electrically connected to a receptacle in the base portion. A key lock unit can be rotated to position so that the cover cannot be removed. In one form of the device a twist lock cap is used, and in another form disclosed a straight line motion is used for mounting the cap.

Because the unit is made so that it can be easily molded, the device is economical, and yet secure, and as strong and rigid as other existing devices which do not have the quick removal feature.

The importance of the quick removal feature is that when a party leaves an automobile having an antenna on it parked for any length of time the antenna can be removed and stored inside, out of sight, or can be carried with the party for security. The removal of the antenna not only eliminates the likelihood of damage to the antenna itself, but removes an obvious signal to thieves that would like to steal the radio equipment with which the antenna is used. The base which remains is relatively unobtrusive, and not easily noticed. This tends to reduce attracting of attention to the antenna system.

BRIEF DESCRIPTION OF THE DRAWINGS

FIG. 1 is a side elevational view of an antenna coupling made according to a first form of the present invention;

FIG. 2 is a fragmentary sectional view taken as on line 2—2 in FIG. 1;

FIG. 3 is a sectional view taken as on line 3—3 in FIG. 2;

FIG. 4 is a sectional view taken as on line 4—4 in FIG. 3;

FIG. 4A is a sectional view taken as on line 4A—4A in FIG. 4;

FIG. 5 is a vertical sectional view of a modified form of the present invention; and FIG. 6 is a sectional view taken as on line 6—6 in FIG. 5.

DESCRIPTION OF THE PREFERRED EMBODIMENTS

In a first form of the invention a quick disconnect antenna coupling illustrated generally at 10 as shown includes a base member 11, and a cap member 12. The base member is mounted onto a vehicle trunk lid 13, or other suitable metal panel of a vehicle, in the usual manner. A clamping bracket 14 is used for holding the base and it extends through a provided opening 15 in the panel. A threaded screw clamps against the panel 15 to securely hold bracket 14 and the base 11 to the panel 15. A gasket 16 is used under the base.

The cap 12 has an antenna 20 mounted thereto, through a suitable ferrule 21, and the lower end of the antenna 20, as illustrated at 20A, is electrically connected to a male connector member 23 that is mounted in a suitable housing 24 that in turn is fixed to the interior portions of the cap 12. The male antenna connector is on the central axis of the cover and located within the housing. An adapter 24A has an external thread over which the lower portion 21A of the antenna is threadably secured to the adapter to secure the assembly. After assembly a rivet 28B may be used to secure the antenna components from unscrewing from the cap.

The cap includes an outer locking ring 25 that is at the base of the ferrule 21, and which is secured to the lower portion of the antenna as described. Other adapters may be used for different style antennas so the cap locking member can be easily adapted to a wide selection of antennas.

The locking ring 25 of the cap includes an annular flange 26 with outer serrations or irregularities that make it easy to grip, and this flange 26 extends downwardly at the outer periphery of the cap and has four inwardly extending dogs or lugs 27 positioned at 90° apart (see FIGS. 2 and 4). These lugs 27 are spaced from each other to form a twist lock arrangement, and it can be seen that when the locking ring 25 is properly positioned, it will fit over and slip down onto an upper lock top 30 of the base 11.

Additionally, the locking ring 25 has an integral or fixedly attached depending locking finger or prong 28 which protrudes downwardly farther than the lugs 27. When the cap 25 is placed onto the base 12, the locking finger will pass through a provided aperture 31 in the base.

The aperture 31 is provided in the top wall 32 of the housing 11, and four lugs 34, as can be seen, extend radially out from the top wall 32. The lugs 27 can be positioned between the lugs 34 when the cover is installed so that the flange 26 can be slipped down over the top portion 30 of the base 11 when the locking lugs 27 are positioned as shown in dotted lines in FIG. 4. At the same time, by proper orientation, the finger 28 can be inserted through the opening 31.

It should be noted that the skirt or side wall of the base 11 also has a key lock unit 35 thereon which is mounted in a housing 36 formed in the side wall of the base 11. This key lock unit has a locking tang or cam that can be rotated 90° from an unlocked position to a locked position, which is shown in solid lines in FIGS. 2, 3 and 4. The unlocked position is shown in dotted lines in FIG. 3. With the tang 36 in its unlocked position the finger 28 can pass downwardly through the opening 31 as the cap is placed over the upper portion 30 of base 14. The flange 26 of locking ring 25 moves to position so that the locking lugs 27 are below the plane of the lower surfaces of the lugs 34. Then the cap 12 can be rotated in direction opposite from that indicated by the arrow 37 and the cap lugs 27 will move underneath the base lugs 34 so that the locking ring 25 and its carried components, including the ferrule 21 and the antenna 20, cannot be removed from the base.

The locking finger 28 will then be moved to position as shown in solid lines in FIGS. 2, 3 and 4, with the edge of the locking finger 28 engaging an edge 40 of the opening 31. The finger 28 will be stopped from clockwise movement in this position (as seen in FIG. 4). This will prevent the locking ring 25 from being twisted too far to a position where the lugs 27 would clear the lugs 34.

Once the locking finger 28 is against the edge 40 as shown in FIG. 4, the key lock unit 35 can be rotated so that the tang 36 is upright as shown in FIG. 3, and also in FIG. 4. The tang 36 is locked in this position and cannot be turned to unlocked position unless a key is used. The tang 36 will prevent rotation of the locking ring 25 in the direction as indicated by the arrow 37. The locking ring 25 is then trapped and held securely so that the cover 12 cannot be removed from the base 11 until the key lock 35 is rotated to move the tang 36 to position where it clears the locking finger 28.

The center portion of the top wall 32 on base 11 has a depending socket 43 integrally molded therewith, and a female antenna connector 44 is mounted in this socket. The antenna connector 44 as shown is positioned so that it will receive the male connector 23 when the cover is axially moved into place, as shown in FIG. 2 and will provide an electrical connection between the connector 44 and the connector 23. An antenna wire 45 can be connected to the connector 44 for the lead antenna connection of a radio.

The male connector 23 will rotate inside the female connector 44 as the cap is twist locked to the base, and will provide a good electrical connection for the antenna.

The key lock unit can be of any desired type, such as for example, one made by the Corbin Lock Company, their disc tumbler cam lock type. The key lock would have a removable key for operation (not shown) which is operated in a normal manner for locking and unlocking the unit by movement of the tang 36 substantially 90°.

In FIG. 4A a ground connection arrangement is shown in detail. The upper wall 32 of the housing has a molded in receptacle 45 which receives a ground screw housing 46 having a spring tang 47 that extends annularly over the top wall 32 and within a formed receptacle 47A. The receptacle has a small rubber or resilient bumper 48 mounted therein and supported in the receptacle. The tang 47 overlies the bumper and is urged upwardly by the bumper. The bumper is compressible to resiliently urge the tang toward the overlying cover 12.

The adapter 24A as shown comprises a nut to which the antenna is attached, and the nut has an annular flange 24B that extends on the inside of the cap around the central axis of the antenna. The flange 24B will engage the tang or contactor as the cap 12 is put into place. The bumper 48 will be compressed and a ground connection made to the flange 24B. The housing 46 will be connected to a ground wire.

The ground connection between the cap and base is therefore easy to manufacture and provides a good electrical connection because of the backing of the rubber bumper 48 on the contactor or tang 47. Rotational locking or unlocking movement of the cap, as is described is permitted by the ground contactor assembly.

Further, the lugs 27 or 34 (or both) may have a ramp surface to tighten the cap 12 and base together as the cap is put into place. This will tighten the flange 24B against the tang and bumper. The bumper thus positively exerts a pressure for good electrical contact.

When the antenna cap 12 is to be removed from the base 11 for any reason, such as security, the key lock is moved to lower the tang 36 to its dotted line position, and then the cap locking ring 25 is rotated in direction as shown by the arrow 37, until the lugs 27 will pass between the lugs 34 generally as shown in dotted lines in FIG. 4. Then the entire cap 12 can be lifted up; the male connector 23 will be removed from the female connector 44, and the finger 28 will lift out of the opening 31. Replacement is the reverse procedure, namely placing the cap in position so that the finger 28 will pass into the opening 31 above the tang 36 (with the tang in its unlocked position); pushing the flange 26 down over the top portion 30 of the base; and then twist locking the cap an eighth of a turn to bring the finger 28, which is integrally molded or fixedly attached to the locking ring 25 against the edge 40, stopping it in its position with the locking lugs 27 underneath the lugs 34. Then the lock member 35 is moved so that the tang 36 is upright, the key can be removed, and the unit will be held in its locked condition.

Referring to FIGS. 5 and 6, a modified form of the present invention is disclosed. In this form, a quick disconnect antenna coupler is indicated generally at 50 and includes a base member 51 and a cap member at 52. The base member is mounted onto a suitable vehicle panel using a clip member 53A in the manner previously described, and a gasket 54 can be used between the mounting surface and the base member 51. The device shown in FIGS. 5 and 6 does not have a twist lock cap, but has a cap which is installed on the base member 51 with a linear or longitudinally axial movement.

As can be seen, the base member 51 has a top wall 54 that is joined to a lower portion 55 at a shoulder 56. The shoulder 56 is an annular shoulder that extends around the base member. The base member top wall 54 has three apertures which are defined by collars 57. The apertures are positioned to receive pegs or prongs 58 that are formed integrally with the cover member 52.

The cover member 52 includes a skirt 53 that fits around the upper portion of the base and against the shoulder 56 when the prongs 58 are inserted through the apertures 57. Additionally, the cover member supports a base 62 of the antenna which can be of a different design from the antenna shown in FIGS. 1 through 4. The antenna end indicated at 63 is connected to a male connector 65 carried by the cover member 52, and as shown, the top wall 54 has a collar 66 that receives a female antenna connector 67, which can in turn be connected to an antenna lead as previously described. The male connector 65 will connect to the connector 67 when the cap member 52 is installed on the base 51 with a linear motion by inserting the prongs 58 through the apertures defined by the collars 57. The male connector is held in place by an adapter 64 onto which the base 62 of the antenna can be threaded and locked in place.

Additionally, the top wall 54 of the base has an aperture 68 that is positioned adjacent one side thereof, and this aperture 68 is of size to permit a cam member 72 carried by a key lock assembly 73 to pass through the aperture when the cam member is in its unlocked position (180° from the position shown in FIGS. 5 and 6). The cam 72 is a disc that is eccentrically mounted onto the key lock shank 74 and is held in place with a nut 75. The cam disc 72 is thereby rotationally driven when the lock 73 is operated. The lock 73 has an external key entry plate 75, which is accessible from the top of the cap 52, and the lock itself is securely held in place in the cap in a suitable manner such as with a snap ring or similar holding device.

The aperture 68 is surrounded by a heavy collar 80, and a portion of the collar includes a cam surface 81 on the locking side of the collar. A stop lug 82 can also be used to prevent the cam disc 72 from being rotated clockwise beyond its locked position as shown in FIG. 6. The cam disc itself can have a step or offset that fits underneath the ramp 81, so that when the key lock is rotated, and the cam is moved to locked position by movement in clockwise direction as shown in FIG. 6, the cap 52 will be tightened down securely onto the base by this locking action.

When the key is removed, after the unit is locked, the cover is securely held in place. It should be noted that the prongs 58 will prevent rotation of the cap relative to the base, and the only way that the cap can be removed is by an upwardly movement. This upward movement in longitudinal axial direction is prevented by the cam disc 72 engaging the ramp 81.

Unlocking is achieved by using a key to operate the lock 73 in a counterclockwise direction as viewed in FIG. 6 and moving the cam to a position where it will clear ramp 81 and pass through the aperture 68, after it has been rotated 180° from its solid line position in FIG. 6. Then the cap itself can be lifted upwardly off the base for removal of the cap and the attached antenna for security purposes. The axial direction of movement of the cap as the prongs 58 pass through the apertures defined by the collars 57 serves to connect the male and female antenna connectors in a positive manner.

When the coupler is locked by turning the key and the cam disc 72 it is assured that the cap is securely seated on the base.

It should be noted that the caps in both forms of the invention can be designed to take different manufacturers' antenna connectors merely by modifying the adapters in the central portions of the cap, and attaching the parts to the cap itself. In this way, the locking portions, namely the cap and the base, can be adapted to a wide variety of different manufacturers' antennas with very little difference in operation, and with only a few parts being necessary for the adaptation.

The locking finger 28 in the first form of the invention and the prongs or pins 58 in the second form and their cooperating apertures also serve to index the cover and base to proper position for latching before the caps are slipped onto the respective bases. With finger 28 in aperture 31 and against the opposite end of the aperture from end 40 the twist lock lugs are in position for assembly. The prongs 57 index cam 72 so it will pass through opening 68 for assembly.

What is claimed is:

1. An antenna connector assembly for antennas of mobile vehicles such as C.B. antennas including a base member mountable on a mobile vehicle, a cover member adapted to be mounted on said base member, an antenna mounted on said cover member, an antenna lead mounted on said base member, means to electrically connect said antenna lead and said antenna when the cover member is mounted on said base member, said base and cover members including cooperating interlocking twist lock lugs movable from a released to a latched position upon relative motion of said base member and cover member, a locking finger mounted on one of said members and protruding into the other of said members when the twist lock lugs are in a latched position and the cover member is mounted on the base member, and means to lockably connect said base member and said cover member including a key operated lock mounted on said other member and having a cam movable between a locked and an unlocked position, said cam intercepting said locking finger and preventing movement of said cover member relative to said base member by interfering with movement of said locking finger and preventing the relative movement of said base and cover members which moves the twist lock members from latched to released position when said cam is in its locked position with the cover member mounted on said base member, and permitting movement of said locking finger and separating movement of said cover member and base member when the cam is moved to an unlocked position.

2. The combination as specified in claim 1 wherein said other member has a surface overlying the surface on which the assembly is mounted, a receptacle defined in said surface, said finger on the one member fitting into said receptacle, motion of the base and cover members to latch said twist lock lugs causing said finger to engage a side of said receptacle for stopping relative locking motion, and said cam on said lock means interfering with reverse movement of said finger when the cam is in its locked position and thereby preventing unlocked motion of said twist lock lugs.

3. The combinaion of claim 1 wherein said means to electrically connect comprises a connector on said cover having a downwardly facing electrically conductive surface, a conductive strip on said base having an upwardly facing surface and being secured at one end to said base, and a resilient bumper under the other end of said strip to urge the strip into engagement with the electrically conductive surface of said connector on said cover.

4. The combination of claim 3 wherein said base has an upper wall, a recess in said upper wall mounting said strip and resilient bumper.

5. In combination with an antenna for mounting onto a wall of a mobile vehicle comprising a base member, means for attaching the base member to a mobile vehicle, a separable cover member carrying an antenna, cooperating means between said base member and said cover member to provide electrical connection therebetween, means on said base member to receive and support said cover member and an antenna carried thereby, said base member having a support wall spaced from and overlying the vehicle wall on which the base member is mounted, said support wall having an aperture therethrough, the improvement comprising an elongated prong spaced from said antenna and protruding from the cover member positioned and of size to fit through the aperture in said support wall when the cover member is placed on said base member, and key operated lock means on one of said members movable from a locked to an unlocked position and including a cam movable under key operation to a position to prevent removal of said cover member from said base member when the cover member is on said base member with the prong extending through said aperture to orient the cooperating means to make an electrical connection when said lock means is in said locked position.

6. The combination as specified in claim 5 wherein said prong and aperture comprise indexing means to index said cover to a proper position to permit said cover and said base to be moved together when said lock means is in its unlocked position.

7. The combination as specified in claim 5 wherein said cover and said base member include cooperating twist lock lugs to prevent removal of said cover when said cover is mounted on said base and is rotated to a preselected position, and said cam means being movable to position to interfere with movement of said prong to prevent rotation of said cover member to position to release said lugs.

* * * * *

UNITED STATES PATENT OFFICE

CERTIFICATE OF CORRECTION

Patent No. 4,096,481 Dated June 20, 1978

Inventor(s) Stanley W. Widmer et al.

It is certified that error appears in the above-identified patent and that said Letters Patent are hereby corrected as shown below:

Column 6, line 59, (Claim 2, line 11), "unlocked" should be --unlocking--.

Signed and Sealed this

*Twenty-eighth* Day of *November 1978*

[SEAL]

*Attest:*

RUTH C. MASON
*Attesting Officer*

DONALD W. BANNER
*Commissioner of Patents and Trademarks*